US008099843B2

(12) United States Patent
Zhang et al.

(10) Patent No.: US 8,099,843 B2
(45) Date of Patent: Jan. 24, 2012

(54) DEVICE FOR MOLDING BISTABLE MAGNETIC ALLOY WIRE

(76) Inventors: Nianrong Zhang, Nanjing (CN); Huijun Xu, Nanjing (CN); Yun Zhu, Nanjing (CN); Zhuhui Zheng, Nanjing (CN); Jian Chen, Nanjing (CN); Fang Yu, Nanjing (CN)

( * ) Notice: Subject to any disclaimer, the term of this patent is extended or adjusted under 35 U.S.C. 154(b) by 0 days.

(21) Appl. No.: 12/843,070

(22) Filed: Jul. 26, 2010

(65) Prior Publication Data

US 2010/0287753 A1 Nov. 18, 2010

Related U.S. Application Data

(62) Division of application No. 11/848,406, filed on Aug. 31, 2007.

(30) Foreign Application Priority Data

Sep. 1, 2006 (CN) ..... 2006 1 0086134

(51) Int. Cl.
*B21C 23/08* (2006.01)

(52) U.S. Cl. ..... 29/33 F; 242/364; 72/64

(58) Field of Classification Search ..... 29/33 F; 57/282, 288; 72/77, 112, 120, 64, 65, 79, 72/160, 161, 164, 165, 289, 371; 148/120; 242/325.3, 364–366.4, 615.1, 615.2; 140/149
See application file for complete search history.

(56) References Cited

U.S. PATENT DOCUMENTS

| | | | | |
|---|---|---|---|---|
| 2,250,610 | A * | 7/1941 | Simons | 72/64 |
| 2,442,219 | A * | 5/1948 | Stanley | 420/104 |
| 2,881,822 | A * | 4/1959 | Henry | 72/364 |
| 3,009,312 | A * | 11/1961 | Seem et al. | 57/283 |
| 3,820,090 | A * | 6/1974 | Wiegand | 365/133 |
| 3,932,986 | A * | 1/1976 | Kosaka et al. | 57/283 |
| 4,481,996 | A * | 11/1984 | De Bondt et al. | 152/451 |
| 4,591,788 | A * | 5/1986 | Mohri et al. | 324/260 |
| 4,785,244 | A * | 11/1988 | Jin et al. | 324/260 |
| 5,634,363 | A * | 6/1997 | Shozaki et al. | 72/39 |
| 2003/0122028 | A1 * | 7/2003 | Abba et al. | 242/566 |
| 2005/0092866 | A1 * | 5/2005 | Bell et al. | 242/615.1 |
| 2005/0163434 | A1 * | 7/2005 | Kwon et al. | 385/88 |

* cited by examiner

*Primary Examiner* — David Bryant
*Assistant Examiner* — Jacob Cigna
(74) *Attorney, Agent, or Firm* — Matthias Scholl P.C.; Matthias Scholl

(57) ABSTRACT

A device for molding a bistable magnetic alloy wire having a feed reel, a feed roller, a furnace, a positioning roller, a receiving roller, and a receiving reel; a winch for passing the alloy wire through is disposed between the positioning roller and the receiving roller; the winch rotates around its axis; at least three wheels are distributed along the axis of the winch; the alloy wire passes an upper tangent point and a lower tangent point of an outer circle of the wheel; and the upper tangent point and the lower tangent point are disposed on the top and the bottom of the axis of the winch, respectively.

25 Claims, 3 Drawing Sheets

DEVICE FOR MOLDING BISTABLE MAGNETIC ALLOY WIRE

CROSS-REFERENCE TO RELATED APPLICATIONS

This application is a divisional of U.S. Ser. No. 11/848,406 filed on Aug. 31, 2007, now pending. This application claims foreign priority benefits to Chinese Patent Application No. 200610086134.5 filed on Sep. 1, 2006. The contents of the aforementioned specifications are incorporated herein by reference in their entirety.

BACKGROUND OF THE INVENTION

1. Field of the Invention

The invention relates to a device for molding bistable magnetic alloy wire.

2. Description of the Related Art

Certain ferromagnetic alloy materials, such as Fe—Ni alloy, Fe—Co—V alloy and so on, have different magnetic properties due to different modeling methods. The greater the deformation generated by a material process, the higher the energy required to alter the state of the magnet (i.e. the coercivity will be larger); and conversely, the smaller the degree of deformation, the weaker the energy required to alter the state of the magnet (i.e. the coercivity will be smaller). In a proper technical condition, an alloy wire with uniform components can be formed into a magnetic wire with dual magnetism, namely, a relatively soft core and hard shell.

This kind of alloy wire features a bistable magnetic performance: firstly, a magnetic field is applied outwards along an axis of the alloy wire, so as to make it saturatedly magnetized, after the magnetic field is removed, due to a high coercivity of the shell and low coercivity of the core, the magnetized shell will maintain in a magnetized direction, and the core is magnetized in an opposite direction due to a bias imposed by the remaining magnetism of the shell. Then, as an opposite magnetic field with large intensity is applied, the magnetization direction of the core will be instantly changed into the same state as the shell. Thereafter, as the outside magnetic field is removed, under the action of the remaining magnetism of the shell, the magnetization direction of the core will be changed to its initial state. The bistable alloy wire can be used in many ways, for example, to produce magnetic storage components or pulse generators, and is a key material to make zero power consumption transducer (a magnetic transducer without a power supply).

At present, manufacture of bistable magnetic alloy wires employs a technology disclosed in U.S. Pat. No. 3,820,090, i.e., the alloy wire is firstly processed by heat treatment, and then by cold treatment. Heat treatment refers to a process of continuously heating the alloy wire, then cooling down, and repeating the process several times, so as to vary the eddy current of an inner layer of the alloy wire from that of the core, and to form a shell with relatively large thermal deformation. The cold treatment processing involves mechanical stretching or mechanical twisting. The mechanical stretching is a process where a pair of opposite forces parallel to the alloy wire are applied to a surface of the alloy wire to increase deformation of the shell; the mechanical twisting is a process where a segmented positioning alloy wire is twisted around an axis back and forth, a line with a unit length is twisted for multiple loops (e.g. 10 loops) in a clockwise (or counterclockwise) direction, and then for the same or different loops in an opposite direction. A permanent torque can be maintained or removed, so that an outer circle of the alloy wire generates a relatively large deformation, and the core maintains small deformation via the mechanical stress method.

An object of dual cold treatment processing is to further increase deformation of the shell, to maintain relatively small deformation of the core, and thus forming a magnetic wire with a relatively soft core and a relatively hard shell.

There are two types of cold treatment devices for a bistable magnetic alloy wire:

1) Mechanical stretching device, comprising a feed reel, a feed roller, a receiving roller, a receiving reel, and two pairs of separated wheels. An alloy wire from the feed reel consecutively passes the feed roller, the wheels, the receiving roller, and finally enters the receiving reel. The receiving reel operates via an electromotor, and a rotating speed of an anterior pair of wheels is less than that of a back pair of wheels, and therefore a tensile force is applied to a surface of the alloy wire, which generates much larger permanent deformation of the shell than of the core.

Disadvantages of these conventional stretching devices are: deformation on the surface is relatively small, and the magnetism of the processed alloy wire is not very high.

2) Mechanical twisting device, which can be a common winding machine. Both ends of a segmented alloy wire are fixed on two fixtures of the winding machine, so as to tighten the alloy wire, after that the fixtures are twisted around an axis of the alloy wire for multiple loops (e.g. 10 loops) in a clockwise (or counterclockwise) direction, and then in an opposite direction for the same number of loops, so that there is a relatively significant deformation on the shell of the alloy wire, and the core maintains a relatively small deformation from the mechanical stress method.

Conventional twisting devices need to segment alloy wires for further processing, which has the following disadvantages: 1) continuous production cannot be achieved, and processing efficiency is low; and 2) the degree of twisting and deformation of each part of the alloy wire is different, which leads to non-uniform magnetism of the alloy wire, and affects applications of the alloy wire in a precision apparatus.

SUMMARY OF THE INVENTION

In view of the above-described problem, it is one objective of the invention to provide a method for molding a bistable magnetic alloy wire.

Another objective of the invention is to provide a device for molding a bistable magnetic alloy wire.

In accordance with one embodiment of the invention, provided is a method for molding the bistable magnetic alloy wire, comprising: 1) processing an alloy wire by heat treatment; and 2) processing the alloy wire by cold treatment of mechanical twisting, the mechanical twisting being a repeated twisting in a continuous state.

In another embodiment of the invention, any one point on the alloy wire moving uniformly undergoes a repeated twisting portion alternatively formed by forward twisting portions and opposite twisting portions; the point is forwardly twisted in the forward twisting portion; and the point is reversely twisted in the opposite twisting portion.

In another embodiment of the invention, the speed of the alloy wire moving uniformly ranges between 0.1 m/min and 5 m/min; an angular speed of forward or reverse twisting of any one point on the alloy wire within the forward or opposite twisting portion ranges from 500 loops/min to 3000 loops/min.; and the length of the forward or opposite twisting portion ranges between 1 cm and 10 cm.

In accordance with one embodiment of the invention, provided is a device for molding a bistable magnetic alloy wire, comprising: a feed reel; a feed roller; a furnace; a positioning roller; a receiving roller; and a receiving reel; a winch for passing through the alloy wire is disposed between the positioning roller and the receiving roller; the winch rotates around its longitudinal axis; at least three wheels are distributed along an axis of the winch; the alloy wire passes an upper tangent point and a lower tangent point of an outer circle of the wheel in turn; and the upper tangent point and the lower tangent point are respectively disposed on the top and the bottom of the axis of the winch.

In another class of this embodiment, diameters of the wheels are the same, and centers thereof are disposed on the axis of the winch.

In another class of this embodiment, the wheels are distributed with equidistance.

In another class of this embodiment, the number of the wheels is odd, e.g. 3, 5, 7, 9, 11, etc.

In another class of this embodiment, the wheels are symmetrically-distributed and centered around a center wheel.

In another class of this embodiment, a distance between the anterior two wheels is greater than that between every two behind wheels.

In another class of this embodiment, a distance between the anterior two wheels is less than that between every two behind wheels.

In another class of this embodiment, a distance between the tangent point of an outer circle of a first wheel and the axis of the winch is greater than that between a tangent point of an outer circle of a second wheel and the axis of the winch.

In another class of this embodiment, a distance between the tangent point of an outer circle of a first wheel and the axis of the winch is less than that between a tangent point of an outer circle of a second wheel and the axis of the winch.

One advantage of the device of the invention is that during the mechanical twisting process, the alloy wire is processed by continuous repeated twisting in the forward or reverse twisting portions while moving uniformly forward; the twisting degree of the arbitrary point on the alloy wire is constant so a continuous production can be achieved; the production efficiency and the deformation uniformity of the alloy wire is improved. Furthermore, the device allows for a convenient control of the magnetic properties of the alloy wire.

Another advantage of the method of the invention is that as the winch rotates around the axis thereof in a direction (e.g. a clockwise direction), any one point on the alloy wire is twisted in a clockwise (or a counterclockwise) direction in a region formed by a tangent point of an outer circle of an adjacent wheel during uniform motion, twisting directions of adjacent regions are alternately forward or reverse, and thus continuous and alternate forward or reverse twisting of the alloy wire is implemented by which the method for molding bistable magnetic alloy wire of the invention is achieved.

By way of adding or reducing the number of the wheels, and adjusting distances between wheels, distances between a tangent point of an outer circle of a wheel and an axis of the winch, the rotating speed of the winch and the drawing speed of the alloy wire, periods and times of the forward or reverse twisting of the alloy wire can be flexibly adjusted, and thus the deformation of the shell of the alloy wire can be precisely controlled as needed, namely, the magnetic properties of the alloy wire can be controlled effectively. The twisting degree and the deformation of each part of the alloy wire are constant, and therefore the magnetic properties of the alloy wire are uniform. The device of the invention has the advantages of simple structure, artful design, high processing efficiency, and low cost.

DETAILED DESCRIPTION OF THE INVENTION

Further description will be given hereinafter in conjunction with embodiments and with reference to accompanying drawings. However, the invention is not limited to the examples.

Example 1

Figure 2:
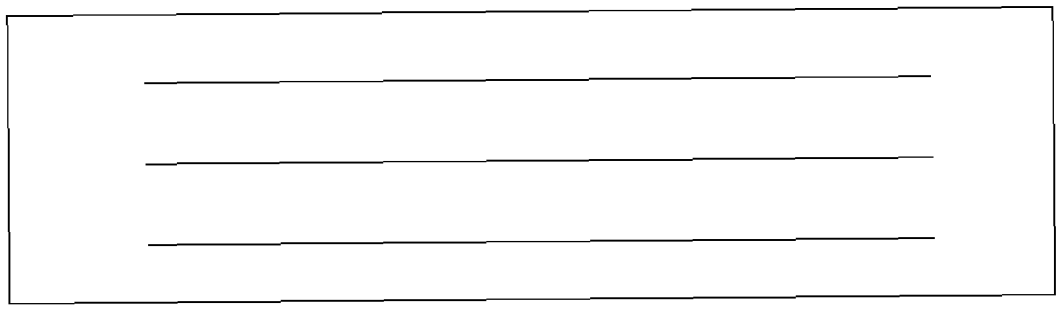
FIG. 2 is a schematic diagram illustrating a linearly-distributed easy magnetization direction parallel to an axis of the alloy wire as a forward and an opposite torque are the same in magnitude.

An alloy wire consisted of 49.1% Fe, 43.1% Co, 7.8% V, and a diameter of the alloy wire was 0.25 millimeters. Firstly, the alloy wire was continually processed 5 times by heat treatment (i.e. being heated up firstly and then being cooled down by air) using a radiant-type furnace, at a heat processing temperature of between 500 and 1000° C. Then, the alloy wire was processed by cold treatment of mechanical twisting: a moving speed of the alloy wire is 5 m/min, and a repeated twisting portion was composed of a forward twisting portion and an opposite twisting portion both with a length of 10 cm, and angular speeds of the two portions are 1200 loops/min The easy magnetization direction of the bistable magnetic alloy wire was parallel to an axis of the alloy wire and was linearly-distributed (as shown in FIG. 2).

If a zero power consumption transducer made by the above material is driven by a symmetrical alternating magnetic field, the alloy wire will be magnetically switched if a magnetic induction of the driving field is 3mT, as the driving field is within a range of 3-12 mT, the output amplitude of an inductive winding with 5000 turns is greater than 1.5 V.

Example 2

An alloy wire consisted of 49.1% Fe, 43.1% Co, 7.8% V, and a diameter of the alloy wire was 0.25 millimeters. Firstly, the alloy wire was continually processed for 5 times by heat treatment (i.e. being heated up firstly and then being cooled down by air) using a radiant-type furnace, at a heat processing temperature of between 500 to 1000° C. Then, the alloy wire was processed by cold treatment of mechanical twisting: a moving speed of the alloy wire is 2 m/min, and a repeated twisting portion is composed of a forward twisting portion and an opposite twisting portion both with a length of 6 cm, and angular speeds of the two portions are 1800 loops/min. The easy magnetization direction of the bistable magnetic alloy wire was parallel to an axis of the alloy wire and was linearly-distributed (as shown in FIG. 2). If a zero power consumption transducer made by the above material is driven by a symmetrical alternating magnetic field, the alloy wire will be magnetically switched if a magnetic induction of the driving field is 3.5 mT, as the driving field is within a range of 4-12 mT, an output amplitude of an inductive winding with 5000 turns will be 2-3V.

Example 3

Figure 3:
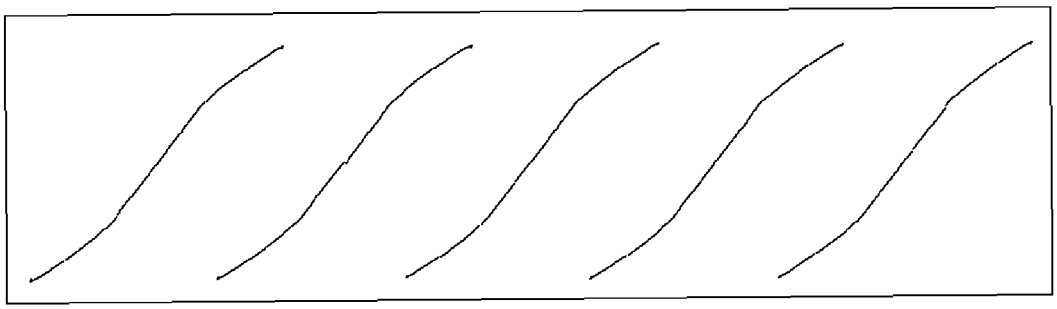
FIG. 3 is a schematic diagram illustrating a spirally-distributed easy magnetization direction of the alloy wire as the forward torque is larger than the directionally-opposite torque.

An alloy wire consisted of 49.1% Fe, 43.1% Co, 7.8% V, and a diameter of the alloy wire was 0.25 millimeters. Firstly, the alloy wire was continually processed for 5 times by heat treatment (i.e. being heated up firstly and then being cooled down by air) using a radiant-type furnace, at a heat processing temperature of between 500 to 1000° C. Then, the alloy wire was processed by cold treatment of mechanical twisting: a moving speed of the alloy wire was 0.5 m/min, and a repeated twisting portion was composed of a forward twisting portion with a length of 3 cm and an opposite twisting portion both with a length of 6 cm, and angular speeds of the two portions were 3000 loops/min The easy magnetization direction of the bistable magnetic alloy wire was spirally-distributed (as shown in FIG. 3). If a zero power consumption transducer made by the above material is driven by a symmetrical alternating magnetic field, the alloy wire will be magnetically switched if a magnetic induction of the driving field is 4.5 mT, as the driving field is within a range of 5-12 mT, an output amplitude of an inductive winding with 5000 turns will be 2V.

Example 4

An alloy wire consisted of 35.4% Fe, 54.5% Co, 10.1% V, and a diameter of the alloy wire was 0.25 millimeters. Firstly, the alloy wire was continually processed for 5 times by heat treatment (i.e. being heated up firstly and then being cooled down by air) using a radiant-type furnace, at a heat processing temperature of between 500 to 1000° C. Then, the alloy wire was processed by cold treatment of mechanical twisting: a moving speed of the alloy wire was 0.1 m/min, and a repeated twisting portion was composed of a forward twisting portion and an opposite twisting portion both with a length of 1 cm, and the angular speeds of the two portions were 500 loops/min. An easy magnetization direction of the bistable magnetic alloy wire was parallel to an axis of the alloy wire and was linearly-distributed (as shown in FIG. 2). If a zero power consumption transducer made by the above material is driven by a symmetrical alternating magnetic field, the alloy wire will be magnetically switched if a magnetic induction of the driving field is 2 mT, as the driving field is within a range of 3-12 mT, an output amplitude of an inductive winding with 5000 turns will be 2-3V.

Example 5

An alloy wire consisted of 35.4% Fe, 54.5% Co, 10.1% V, and a diameter of the alloy wire was 0.25 millimeters. Firstly, the alloy wire was continually processed for 5 times by heat treatment (i.e. being heated up firstly and then being cooled down by air) using a radiant-type furnace, at a heat processing temperature of between 500 to 1000° C. Then, the alloy wire was processed by cold treatment of mechanical twisting: a moving speed of the alloy wire was 2 m/min, and a repeated twisting portion was composed of a forward twisting portion and an opposite twisting portion both with a length of 6 cm, and angular speeds of the two portions were 1200 loops/min The easy magnetization direction of the bistable magnetic alloy wire was parallel to an axis of the alloy wire and linearly-distributed (as shown in FIG. 2). If a zero power consumption transducer made by the above material is driven by a symmetrical alternating magnetic field, the alloy wire will be magnetically switched if a magnetic induction of the driving field is 1.8 mT, as the driving field is within a range of 3-12 mT, an output amplitude of an inductive winding with 5000 turns will be greater than 3V.

Example 6

Figure 4:
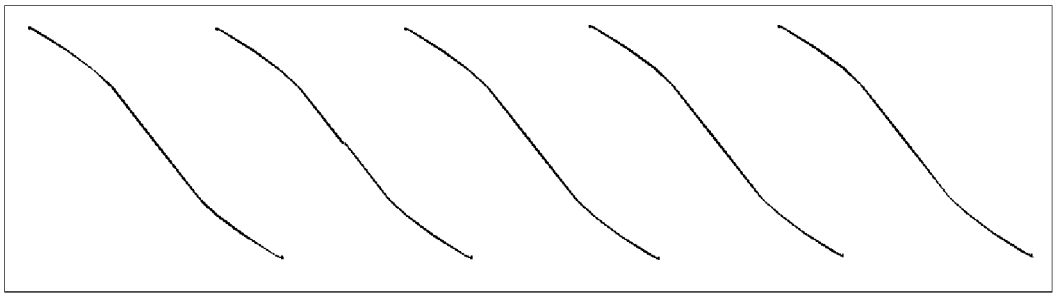
FIG. 4 is a schematic diagram illustrating an inverted-spirally-distributed easy magnetization direction of the alloy wire as the forward torque is smaller than the directionally-opposite torque.

An alloy wire consisted of 35.4% Fe, 54.5% Co, 10.1%% V, and a diameter of the alloy wire was 0.25 millimeters. Firstly, the alloy wire was continually processed for 5 times by heat treatment (i.e. being heated up firstly and then being cooled down by air) using a radiant-type furnace, at a heat processing temperature of between 500 to 1000° C. Then, the alloy wire was processed by cold treatment of mechanical twisting: a moving speed of the alloy wire was 0.5 m/min, and a repeated twisting portion was composed of a forward twisting portion with a length of 9 cm and an opposite twisting portion with a length of 6 cm, and angular speeds of the two portions were 2400 loops/min The easy magnetization direction of the bistable magnetic alloy wire was inverted-spirally-distributed (as shown in FIG. 4). If a zero power consumption transducer made by the above material is driven by a symmetrical alternating magnetic field, the alloy wire will be magnetically switched if a magnetic induction of the driving field is 3.5 mT, as the driving field is within a range of 4-12 mT, an output amplitude of an inductive winding with 5000 turns will be greater than 3V.

Magnetism of the alloy wire is affected by factors such as the material the wire is made of and so on. Under the same chemical conditions, the thicker the alloy wire is (such as 0.3 mm vs. 0.25 mm), the better the magnetic properties will be.

Figure 1:
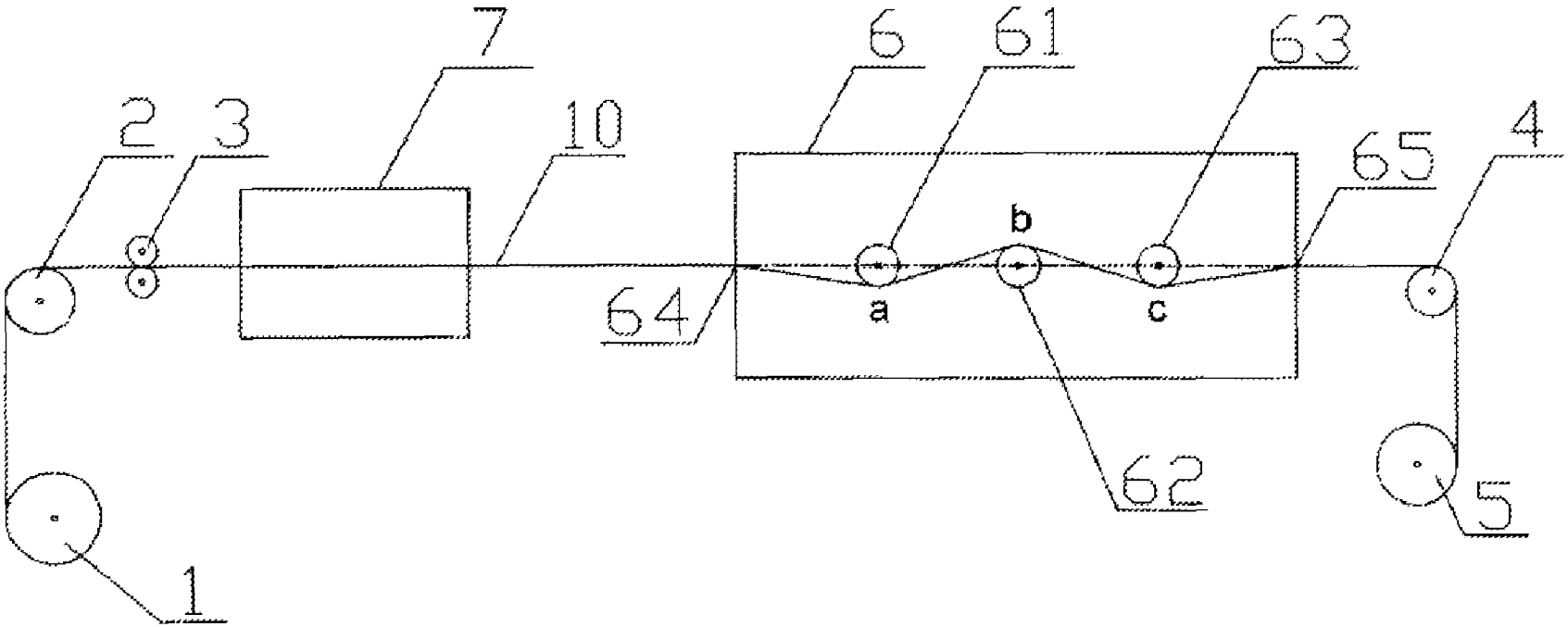
FIG. 1 is a schematic diagram of a device for molding a bistable magnetic alloy wire according to one embodiment of the invention.

As shown in FIG. 1, a device for molding a bistable magnetic wire of the invention comprises a feed reel 1, a feed roller 2, a furnace 7, a positioning roller 3, a receiving roller 4 and a receiving reel 5. A winch 6 for passing through the alloy wire 10 is disposed between the positioning roller 3 and the receiving roller 4, and rotates around an axis thereof. At least three wheels 61, 62, and 63 are distributed along an axis of the winch 6. The alloy wire 10 passes a lower tangent point a of the outer circle of the wheel 61, an upper tangent point b of the outer circle of the wheel 62, and a lower tangent point c of the outer circle of the wheel 63 in the form of a wave. The lower tangent points a and c, and the upper tangent point b are located at the top and the bottom of the axis of the winch, respectively.

In one embodiment of the device, the winch 6 rotates around its axis; three wheels 61, 62, 63 with diameters of 10 mm are distributed in a direction of the axis of the winch 6, and a center of each wheel is centered on the axis of the winch 6. Holes 64 and 65 are disposed at both ends of the winch 6. The alloy wire 10 is passes through the winch 6 via the holes 64, 65. The alloy wire 10 in the winch 6 alternately passes the upper tangent point b and the lower tangent points a and c in a wave form. The upper tangent point b and the lower tangent points a and c are respectively located on the top and the bottom of the axis of the winch. The winch 6 rotates in the clockwise direction around its longitudinal axis in a movement direction of the alloy wire 10. Under the action of clockwise twisting forces, any one point on the alloy wire 10 is forwardly (and clockwise) twisted for several times when passing between the tangent point a of the outer circle of the wheel 61 and the tangent point b of the outer circle of the wheel 62. Under the action of counterclockwise twisting forces, any one point on the alloy wire 10 is oppositely (counterclockwise) twisted for the same times when being between the tangent point b of an outer circle of the wheel 62 and the tangent point c of an outer circle of the wheel 63. The force in the forward twisting portion is equal to the force in the opposite twisting portion, but the directions of the two forces are opposite. The forward twisting and the opposite twisting occur alternately, and therefore continuous and repeated twisting is implemented as the alloy wire uniformly passes through the winch. As shown in FIG. 2, since a forward torque and an opposite torque are the same. the easy magnetization direction of the deformed alloy wire is linearly-distributed and parallel to the longitudinal axis of the alloy wire.

As shown in FIGS. 3 and 4, in certain situations, the easy magnetization direction is spirally-distributed or inverted-spirally-distributed. This can be done by increasing or decreasing the distance between the wheels 61 and 62 (such as in Examples 3 and 6), or by increasing or decreasing the distance between the tangent point a of the outer circle of the first wheel 61 and the axis of the winch. If the distance between the tangent point a of the outer circle of the wheel 61 and the axis of the winch needs to be increased, it is only required to move the center of the wheel 61 downwards a certain distance (such as, e.g., 3 mm) If the distance between the tangent point a of the outer circle of the wheel 61 and the axis of the winch needs to be decreased, it is only required to move the center of the wheel 61 upwards for a certain distance (such as, e.g., 2 mm).

The number of the wheels can be an odd number greater than or equal to 3, for example, 3, 5, 7, 9, 11, and so on. An operating principle and a processing procedure for 5, 7, 9 and 11 wheels are similar to those for 3 wheels. The wheels can be symmetrically-distributed and centered by a wheel in the center. The distance between the anterior two wheels can be greater than that between every two wheels behind. The distance between anterior two wheels can be less than that between every two wheels behind. The distance between the tangent point of the outer circle of the first wheel and the axis of the winch can be greater than that between the tangent point of the outer circle of the second wheel and the axis of the winch. The distance between the tangent point of the outer circle of the first wheel and the axis of the winch can be less than that between the tangent point of the outer circle of the second wheel and the axis of the winch.

By way of adding or subtracting the number of the wheels, adjusting distances between wheels and the distance between the tangent point of the outer circle of a wheel and the axis of the winch, and/or adjusting the rotating speed of the winch and the drawing speed of the alloy wire, the twisting times of the alloy wire can be flexibly changed, and thus the deformation of the shell of the alloy wire can be precisely controlled.

This invention is not to be limited to the specific embodiments disclosed herein and modifications for various applications and other embodiments are intended to be included within the scope of the appended claims. While this invention has been described in connection with particular examples thereof, the true scope of the invention should not be so limited since other modifications will become apparent to the skilled practitioner upon a study of the drawings, specification, and following claims.

All publications and patent applications mentioned in this specification are indicative of the level of skill of those skilled in the art to which this invention pertains. All publications and patent applications mentioned in this specification are herein incorporated by reference to the same extent as if each individual publication or patent application mentioned in this specification was specifically and individually indicated to be incorporated by reference.

The invention claimed is:

1. A device for molding a bistable magnetic alloy wire, comprising:

a feed reel (1);
a feed roller (2);
a furnace (7);
a positioning roller (3);
a receiving roller (4); and
a receiving reel (5);

wherein a winch (6) for passing said alloy wire through is disposed between said positioning roller (3) and said receiving roller (4);
said winch (6) rotates around its axis;
said alloy wire passes a tangent point of said positioning roller (3) and said alloy wire passes a tangent point of said receiving roller (4); the path of movement of said alloy wire from said tangent point of said positioning roller (3) to said tangent point of said receiving roller (4) coincides with said axis of said winch (6);
at least three wheels (61, 62, 63) are distributed along said axis of said winch (6);
said alloy wire passes an upper tangent point (b) of a first outer circle of a first wheel of said wheels and a lower tangent point (a) of a second outer circle of a second wheel of said wheels; and
said upper tangent point (b) and said lower tangent point (a) are disposed on different sides of the axis of said winch (6).

2. The device of claim 1, wherein diameters of the wheels (61, 62, 63) are the same, and centers thereof are disposed on the axis of said winch (6).

3. The device of claim 1, wherein said wheels (61, 62, 63) are distributed at equidistance with respect to each other.

4. The device of claim 1, wherein a distance between two anterior wheels (62,63) is greater than that between every two behind wheels (61, 62).

5. The device of claim 1, wherein a distance between anterior two wheels (62, 63) is less than that between every two behind wheels (61, 62).

6. The device of claim 1, wherein a distance between a tangent point of an outer circle of a first wheel and the axis of said winch (6) is greater than that between a tangent point of an outer circle of a second wheel and the axis of said winch (6).

7. The device of claim 1, wherein a distance between a tangent point of an outer circle of a first wheel and the axis of said winch (6) is less than that between a tangent point of an outer circle of a second wheel and the axis of said winch (6).

8. The device of claim 1, wherein said wheels (61, 62, 63) are fixed in said winch (6) such that said wheels (61, 62, 63) rotate with said winch (6) when said winch (6) rotates around said axis of rotation.

9. The device of claim 1, wherein said winch (6) and said wheels (61, 62, 63) rotate around said axis of rotation.

10. The device of claim 1, wherein said wheels (61, 62, 63) are disposed inside said winch (6).

11. The device of claim 1, wherein when an alloy wire passes through said winch (6) said wheels (61, 62, 63) twist said alloy wire.

12. The device of claim 1, wherein the alloy wire passes a linear distance of between 1 cm and 10 cm from said lower tangent point to said upper tangent point.

13. The device of claim 1, wherein the number of the wheels is odd.

14. The device of claim 13, wherein the wheels are symmetrically-distributed and centered around a center wheel.

15. A device for molding a bistable magnetic alloy wire, comprising:

a feed reel (1);

a feed roller (2);

a furnace (7);

a positioning roller (3);

a receiving roller (4);

a receiving reel (5); and a winch (6) rotatable around an axis of rotation, said winch (6) comprising a first wheel (61), a second wheel (62), and a third wheel (63), each of said wheels (61, 62, 63) having a center;

wherein said winch (6) is disposed between said positioning roller (3) and said receiving roller (4);

said alloy wire passes a tangent point of said positioning roller (3) and said alloy wire passes a tangent point of said receiving roller (4); the path of movement of said alloy wire from said tangent point of said positioning roller (3) to said tangent point of said receiving roller (4) coincides with said axis of said winch (6);

said wheels (61, 62, 63) are distributed along said axis of rotation of said winch (6);

said centers of said wheels (61, 62, 63) are disposed on said axis of rotation;

when an alloy wire passes through said winch (6), the alloy wire passes a first lower tangent point (a) of an outer circle of said first wheel (61); the alloy wire passes an upper tangent point (b) of an outer circle of said second wheel (62); and the alloy wire passes a second lower tangent point (c) of an outer circle of said third wheel (63);

said upper tangent point (b) is disposed above said axis of rotation and said first and second lower tangent points (a and c) are disposed below said axis of rotation;

when said winch (6) rotates around said axis of rotation, the alloy wire in said winch (6) passing between said first lower tangent point (a) and said upper tangent point (b) experiences forward twisting, and the alloy wire passing between said upper tangent point (b) and said second lower tangent point (c) experiences reverse twisting.

16. The device of claim 15, wherein the alloy wire passes a linear distance of between 1 cm and 10 cm from said first lower tangent point (a) to said upper tangent point (b), and the alloy wire passes a linear distance of between 1 cm and 10 cm from said upper tangent point (b) to said second lower tangent point (c).

17. The device of claim 15, wherein said wheels (61, 62, 63) are fixed in said winch (6) such that said wheels (61, 62, 63) rotate with said winch (6) when said winch (6) rotates around said axis of rotation.

18. The device of claim 15, wherein said winch (6) and said wheels (61, 62, 63) rotate around said axis of rotation.

19. The device of claim 15, wherein said wheels (61, 62, 63) are disposed inside said winch (6).

20. A device for molding a bistable magnetic alloy wire, comprising:

a positioning roller (3);

a receiving roller (4); and a winch (6) rotatable around an axis of rotation and comprising a plurality of wheels;

wherein said winch (6) is disposed between said positioning roller (3) and said receiving roller (4);

said alloy wire passes a tangent point of said positioning roller (3) and said alloy wire passes a tangent point of said receiving roller (4); the path of movement of said alloy wire from said tangent point of said positioning roller (3) to said tangent point of said receiving roller (4) coincides with said axis of said winch (6);

when an alloy wire passes through said winch (6), the alloy wire in said winch (6) passes said plurality of wheels such that a plurality of tangent points between the alloy wire and said plurality of wheels are alternately disposed above and below said axis of rotation of said winch (6);

the alloy wire is twisted in one direction when passing between one tangent point and an adjacent tangent point of said plurality of tangent points, and is twisted in the opposite direction when passing between said adjacent tangent point and a next adjacent tangent point.

21. The device of claim 20, wherein the alloy wire passes a linear distance of between 1 cm and 10 cm between two adjacent tangent points of said plurality of tangent points.

22. A device for molding a bistable magnetic alloy wire, comprising:

a feed reel (1);

a feed roller (2);

a furnace (7);

a positioning roller (3);

a receiving roller (4);

a receiving reel (5); and a winch (6) rotatable around an axis of rotation, said winch (6) comprising a plurality of wheels, each of said wheels having a center;

wherein said winch (6) is disposed between said positioning roller (3) and said receiving roller (4);

said alloy wire passes a tangent point of said positioning roller (3) and said alloy wire passes a tangent point of said receiving roller (4); the path of movement of said alloy wire from said tangent point of said positioning roller (3) to said tangent point of said receiving roller (4) coincides with said axis of said winch (6);

said plurality of wheels are centered in said winch (6);

when an alloy wire passes through said winch (6), the alloy wire passes said plurality of wheels in said winch (6) in a wave form.

23. The device of claim 22, wherein a plurality of tangent points between the alloy wire and said plurality of wheels are alternately disposed above and below said axis of rotation of said winch (6).

24. The device of claim 23, wherein the alloy wire is twisted in one direction when passing between one tangent point and an adjacent tangent point of said plurality of tangent points, and is twisted in the opposite direction when passing between said adjacent tangent point and a next adjacent tangent point.

25. The device of claim 23, wherein the alloy wire passes a linear distance of between 1 cm and 10 cm between two adjacent tangent points of said plurality of tangent points.

* * * * *